US005702282A

United States Patent [19]

Beckman et al.

[11] Patent Number: 5,702,282

[45] Date of Patent: Dec. 30, 1997

[54] TOY FEEDING BOTTLE ASSEMBLY

[75] Inventors: Ralph A. Beckman; Stephen A. Schwartz, both of Providence, R.I.; Roseann Radosevich, New Bedford, Mass.; Michele P. Trammell, Williamsburg, Ohio

[73] Assignee: Hasbro, Inc., Pawtucket, R.I.

[21] Appl. No.: 690,656

[22] Filed: Jul. 31, 1996

[51] Int. Cl.[6] ..... A63H 3/52; A63H 33/22; A63G 31/00

[52] U.S. Cl. ..... 446/267; 446/219; 472/72

[58] Field of Search ..... 446/267, 219, 446/227, 304, 489, 485, 69; 362/293, 186; 472/72

[56] References Cited

U.S. PATENT DOCUMENTS

| | | | |
|---|---|---|---|
| 1,692,938 | 11/1928 | Jacobs . | |
| 2,983,812 | 5/1961 | Ashe | 362/186 |
| 3,071,888 | 1/1963 | Knott . | |
| 3,105,324 | 10/1963 | Friedman . | |
| 3,383,675 | 5/1968 | Allerdice et al. | 362/186 X |
| 4,186,513 | 2/1980 | Blum . | |
| 4,479,173 | 10/1984 | Rumpakis | 362/293 X |
| 4,666,417 | 5/1987 | Hillman | 446/267 |
| 5,031,080 | 7/1991 | Aikens et al. | 362/293 X |
| 5,165,781 | 11/1992 | Orak . | |
| 5,176,561 | 1/1993 | Greenberg et al. . | |
| 5,180,071 | 1/1993 | Crosson | 446/227 X |
| 5,180,224 | 1/1993 | Svehaug | 362/293 X |
| 5,186,674 | 2/1993 | Beckhusen et al. | 472/72 X |
| 5,236,384 | 8/1993 | Fabricant et al. . | |
| 5,344,034 | 9/1994 | Eagan | 446/227 X |

FOREIGN PATENT DOCUMENTS

| | | | |
|---|---|---|---|
| 705995 | 3/1954 | United Kingdom | 362/293 |
| 93/23128 | 11/1993 | WIPO | 446/267 |

*Primary Examiner*—D. Neal Muir
*Attorney, Agent, or Firm*—Kurt Benson

[57] ABSTRACT

A toy feeding bottle assembly includes a cup-shaped outer warmer housing, and a feeding bottle which is receivable in the warmer housing. The feeding bottle includes concentric transparent inner and outer bottle sections containing a milky liquid therebetween, and an opaque cap portion received on the bottle section in which the milky liquid is received when the bottle is inverted. The bottle assembly further includes a removable, transparent outer sleeve which is adapted to be retained in the warmer portion or retained on the bottle portion. The sleeve is preferably colored to impart a yellow or orange appearance to the milky liquid so that when the sleeve is received on the bottle, the liquid appears to be a juice, whereas when the sleeve is removed from the bottle, the liquid appears to be milk. The warmer housing and removable sleeve are further provided with interlocking posts and slots so that when an arrow on the cap is aligned with a milk icon on the warmer housing the sleeve is retained in the warmer housing when the bottle is subsequently removed therefrom. However, when the bottle is positioned in the warmer housing so that the arrow on the cap is aligned with a juice icon, and the bottle is thereafter removed, the sleeve remains on the bottle so that the liquid appears to be juice.

8 Claims, 5 Drawing Sheets

TOY FEEDING BOTTLE ASSEMBLY

BACKGROUND AND SUMMARY OF THE INVENTION

The instant invention relates to toy feeding bottles for dolls, and more particularly to a toy feeding bottle which can alternately appear to be filled with milk or juice.

Toy nursing and feeding bottles are well-known in the toy art. In this regard, the U.S. Patents to Jacobs U.S. Pat. No. 1,692,938, Knott U.S. Pat. No. 3,071,888, Friedman U.S. Pat. No. 3,105,324, Blum U.S. Pat. No. 4,186,513 and Greenberg U.S. Pat. No. 5,176,561 represent the closest prior art to the subject invention of which the applicant is aware. Each of the cited patents discloses a toy feeding bottle including a transparent double walled shell containing a liquid therein, and a cap portion received on the shell in which the liquid is received when the bottle is inverted. While the prior art toy bottles are generally effective for their intended purpose, it has been found that there is a lack in the toy art of any type of toy feeding bottle which can alternately appear to be filled with different kinds of liquids.

The instant invention provides a toy feeding bottle assembly in which the bottle can alternately appear to be filled with either milk or juice. The toy feeding bottle assembly includes a warmer assembly, and a feeding bottle which is selectively receivable in the warmer assembly. The feeding bottle includes concentric inner and outer bottle sections containing a milky liquid therebetween, and a cap portion received on the bottle sections in which the milky liquid is received when the bottle is inverted. The concentric bottle sections are transparent so that the milky liquid resembles milk within the bottle, while the cap portion is opaque so that the liquid cannot be seen when it is drained into the cap portion.

The warmer assembly comprises an outer cup-shaped warmer housing and an inner cup-shaped sleeve which is adapted to be alternately retained either inside the outer warmer housing or on the outside of the bottle. The sleeve is preferably colored to impart a yellow or orange appearance to the milky liquid in the bottle so that when the sleeve is received on the bottle, the liquid in the bottle appears to be a juice. The outer warmer housing, the sleeve and the bottle are provided with interlocking posts and slots which rotatably engage and disengage as the bottle is rotatably positioned within the warmer assembly so that the sleeve is either retained in the warmer housing or on the bottle. More specifically, when an arrow on the cap portion of the bottle is rotatably aligned with a milk icon on the outer warmer housing, the posts and slots are rotatably aligned so that sleeve is retained in the outer warmer housing when the bottle is removed from the warmer assembly. However, when the bottle is rotatably positioned in the warmer assembly so that the arrow on the cap is rotatably aligned with a juice icon, the posts and the slots are aligned so that the sleeve is retained on the bottle when the bottle is removed from the warmer assembly.

Accordingly, among the objects of the instant invention are: the provision of a toy feeding bottle which can alternately appear to be filled with two different kinds of liquids; the provision of a toy feeding bottle assembly including a bottle portion, a milky liquid received in the bottle portion, and a removable outer sleeve which imparts a colored appearance to the liquid in the bottle when the sleeve is retained thereon; the provision of a toy feeding bottle assembly further including a cup-shaped outer warmer housing which receives the bottle and sleeve therein; the provision of a toy feeding bottle assembly wherein the warmer housing, the sleeve and the bottle are adapted so that when an arrow on the bottle is aligned with an icon on the warmer housing, the sleeve is retained in warmer housing when the bottle is removed therefrom; and the provision of a toy feeding bottle assembly wherein the sleeve, the warmer housing, and the bottle are further adapted so that when the bottle and sleeve are positioned in the warmer with the arrow aligned with a juice icon, the sleeve is retained on the bottle when the bottle is removed from the warmer assembly.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
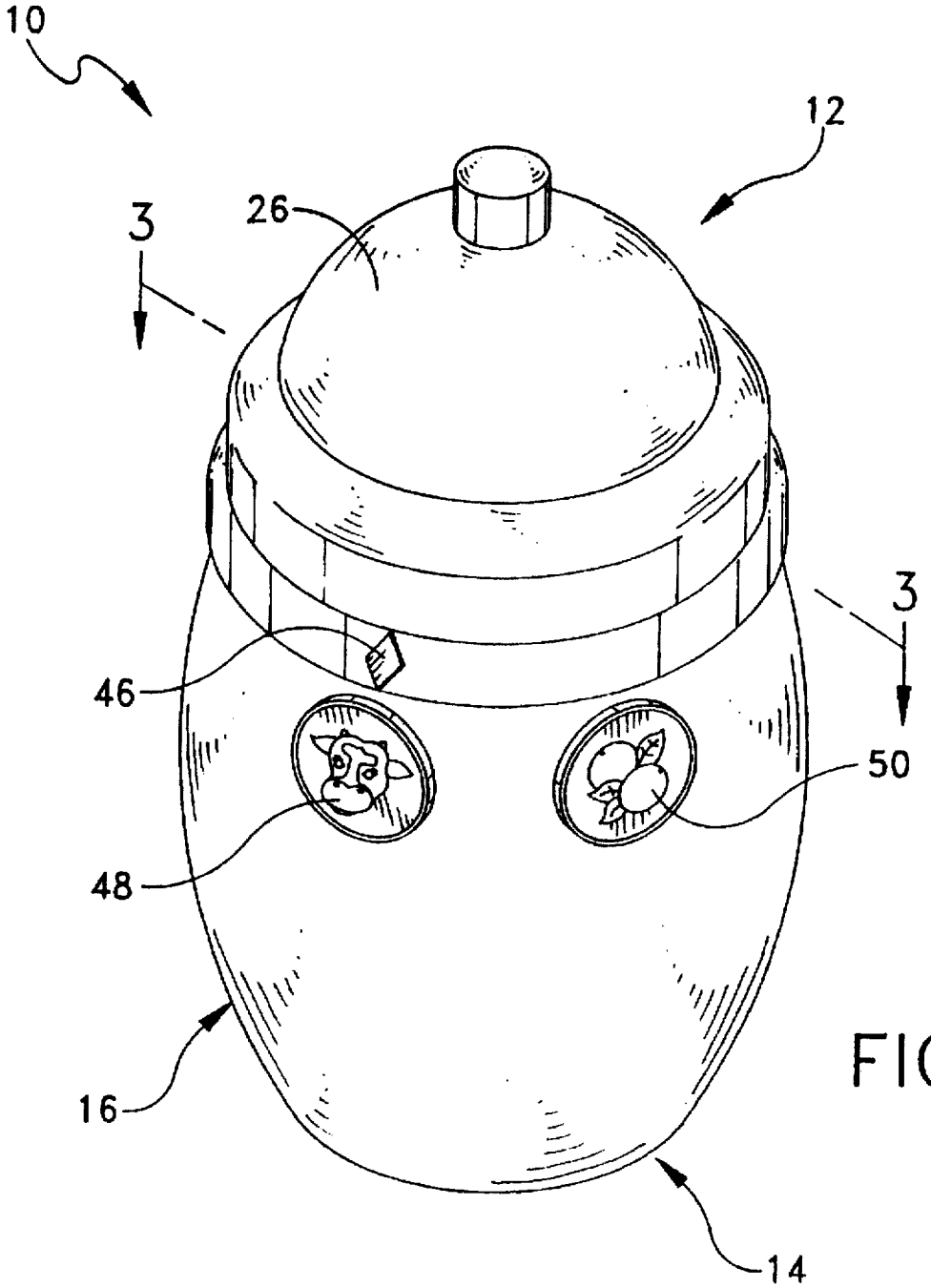
FIG. 1 is a perspective view of the instant toy feeding bottle assembly.

Referring now to the drawings, the toy bottle assembly of the instant invention is illustrated and generally indicated at 10 in FIGS. 1–6. As will hereinafter be more fully described, the instant toy bottle assembly 10 is capable of alternately appearing to be filled with either of two different types of liquids, such as milk and juice.

The toy bottle assembly 10 comprises a bottle generally indicated at 12 and a warmer assembly generally indicated at 14. The warmer assembly 14 comprises an outer cup-shaped warmer housing generally indicated at 16, and an inner cup-shaped sleeve generally indicated at 18. The bottle 12, sleeve 18, and warmer housing 16 are all specially adapted so that the sleeve is selectively retained either on the bottle, or in the warmer housing when the bottle is removed from the warmer assembly 14.

All of the pieces of the bottle assembly 10, including the warmer housing 16, bottle 12, and sleeve 18, are preferably fabricated from conventional plastic materials using injection molding techniques which are well-known in the molding arts. The plastic materials utilized should preferably be rigid and durable enough to withstand play by children.

The bottle 12 comprises a bottle portion generally indicated at 20 including transparent, concentric inner and outer cup-shaped bottle sections 22, 24, respectively, and a liquid received in the space between the inner and outer bottle sections, and further comprises a cap portion 26 received on the bottle portion 20 in the manner shown throughout the drawings. Flow openings (not shown) are provided between the bottle sections 22, 24 and the cap portion 26 so that the liquid flows into the cap portion when the bottle 12 is inverted thereby simulating that the liquid is being gradually drained from the bottle portion when the bottle is in an inverted position. The construction of this type of bottle and cap is known in the art, and therefore the specific details of the flow path of the liquid between the bottle sections and the cap will not be described in detail. The bottle sections 22, 24 are preferably formed from a clear transparent plastic so as to resemble a realistic baby bottle, and the liquid received between the bottle sections is preferably colored a milky white color so as to resemble milk received within the bottle. The cap portion 26 is preferably formed from an opaque plastic so that the liquid cannot be seen when it is received into the cap portion.

The warmer housing 16 is preferably fashioned from an opaque plastic material so that the internal engagement structures of the bottle assembly 10 are normally hidden from view.

Figure 2:
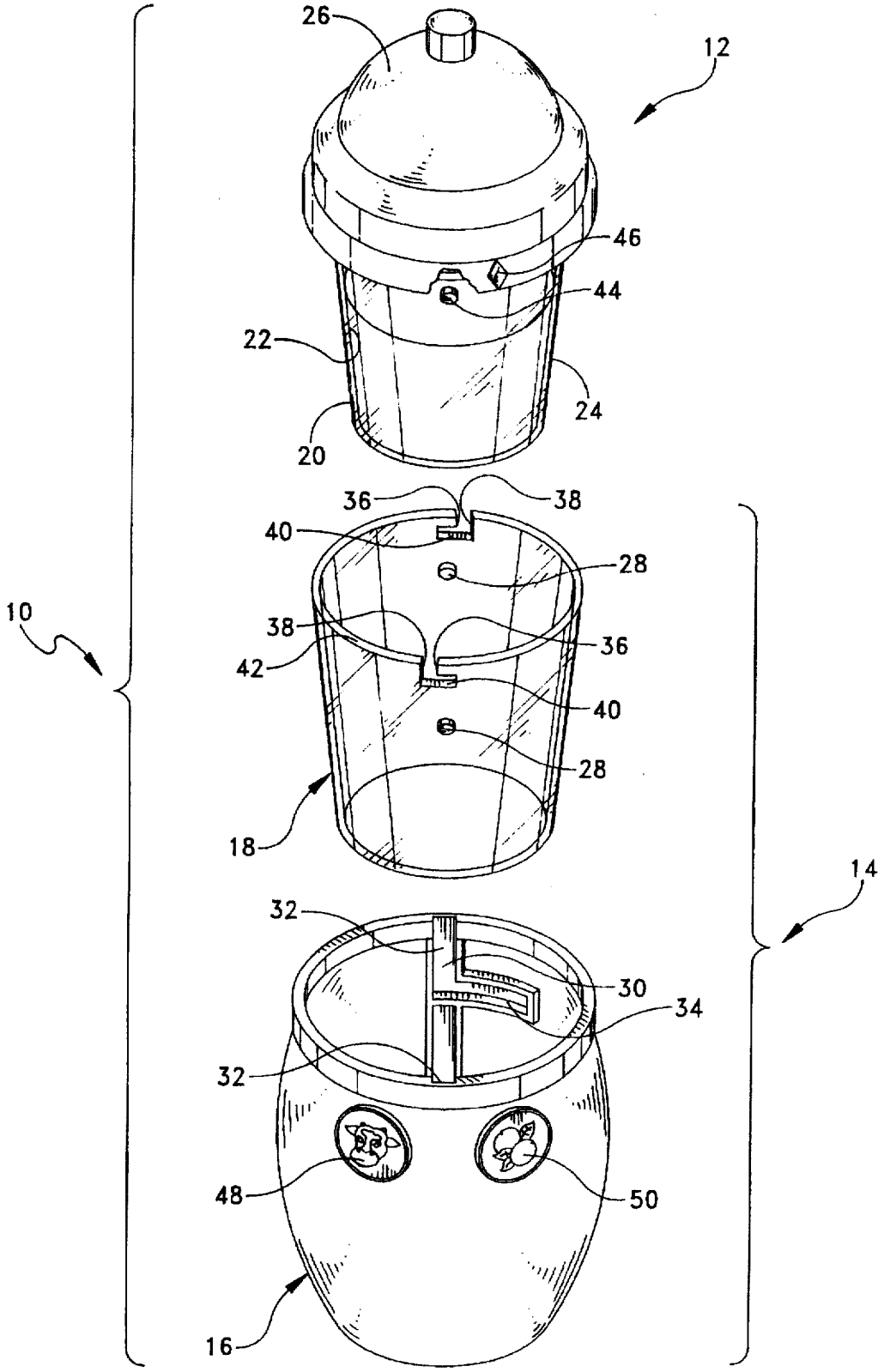
FIG. 2 is an exploded perspective view thereof.
Figure 3:
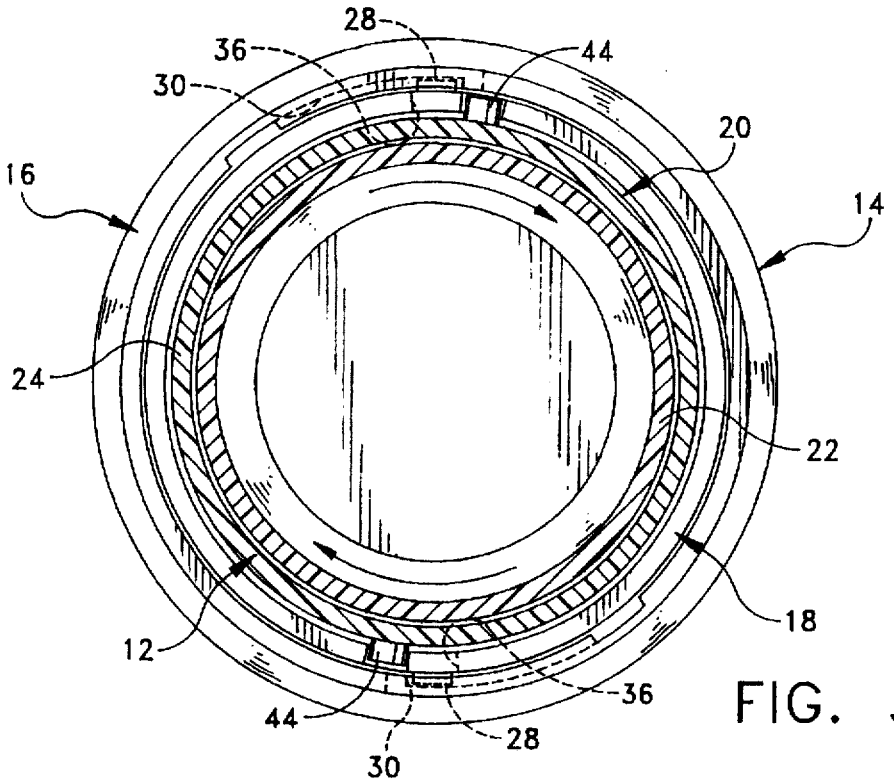
FIG. 3 is a cross-sectional view thereof taken along line 3—3 of FIG. 1.
Figure 5:
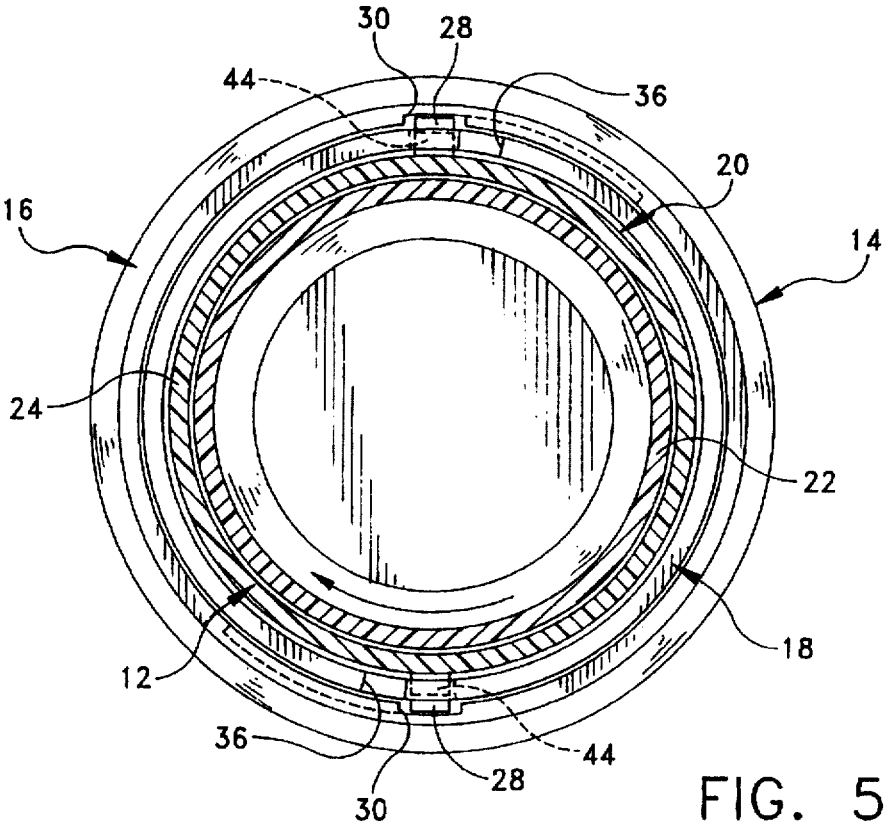
FIG. 5 is another cross-sectional view similar to FIG. 3, showing positioning of the post and slots when the bottle is rotated counterclockwise.

The sleeve 18 is preferably colored so as to impart a different color to the liquid when the sleeve is received on the bottle 12. Referring to FIGS. 1 and 2, it can be seen that the bottle 12, sleeve 18 and warmer housing 16 are receivable in snug interfitting concentric relation. In this regard, it is pointed out the sleeve 18 is dimensioned so that the outer surface of the sleeve is snugly received in facing relation with the inner surface of the warmer housing 16. Likewise, the bottle 12 is dimensioned so that the outer surface of the outer bottle section 24 is snugly received in facing relation with the inner surface of the sleeve 18.

In use, the bottle 12 is selectively receivable inside the warmer assembly 14 and the bottle is rotatable within the warmer assembly in interfitting concentric relation. The bottle 12, warmer housing 16 and sleeve 18 are constructed so that the sleeve is capable of being selectively retained either inside the warmer housing or on the outer surface of the outer bottle section 24 of the bottle portion 20 when the bottle is removed from the warmer assembly 14. As mentioned above, the sleeve 18 is colored so as to impart a different color to the liquid contained between the inner and outer bottle sections 22, 24 of the bottle portion 20 when the sleeve is retained on the bottle. For example, as mentioned above, the sleeve 18 can be colored to impart a yellow or orange appearance to the milky liquid in the bottle so that when the sleeve is received on the bottle 12, the liquid in the bottle appears to be a juice.

The sleeve 18 is selectively interlocked with the warmer housing 16 and selectively interlocked with the bottle portion 20 so as to effect the transformation of the bottle between its milk-containing appearance and its juice-containing appearance. More specifically, the outer warmer housing 16, the sleeve 18 and the bottle 12 are provided with interlocking formations in the form of posts and slots which rotatably engage and disengage as the bottle is rotatably positioned within the warmer assembly so that the sleeve is either retained in the warmer housing or on the bottle. As shown in FIGS. 2–6, the sleeve 18 has a pair of oppositely positioned, outwardly projecting posts 28 which are received in a corresponding pair of notched slots 30 formed on the inner surface of the warmer housing 16.

Figure 4:
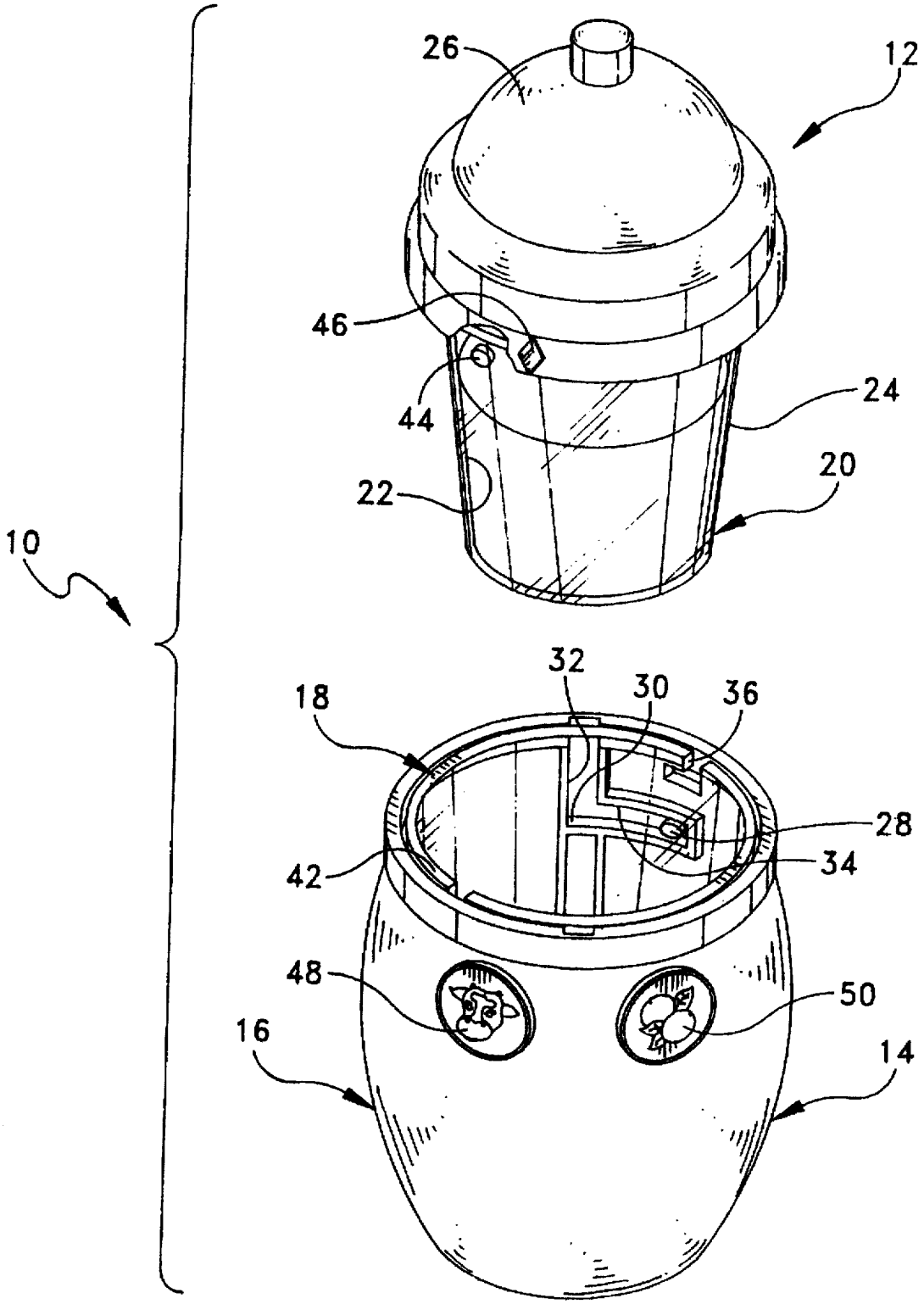
FIG. 4 is an assembly view thereof showing removal of the bottle from the interlocked warmer housing and sleeve when the bottle is rotated clockwise.

As illustrated in FIGS. 2 and 4, the slots 30 are each generally L-shaped to have a vertical portion 32 and a horizontal portion 34 wherein the sleeve 18 is received concentrically within the warmer housing 16 and the posts 28 are slidably received within the vertical portions 32 of the slots 30. Upon being completely received within the warmer housing 16, the sleeve 18 can then be rotated so that the posts 28 travel within the horizontal portions 34 of the slots 30 for locking the sleeve within the warmer housing. In the illustrated embodiment, this arrangement is achieved by rotating the sleeve 18 in a clockwise direction with respect to the warmer housing 16.

Figure 6:
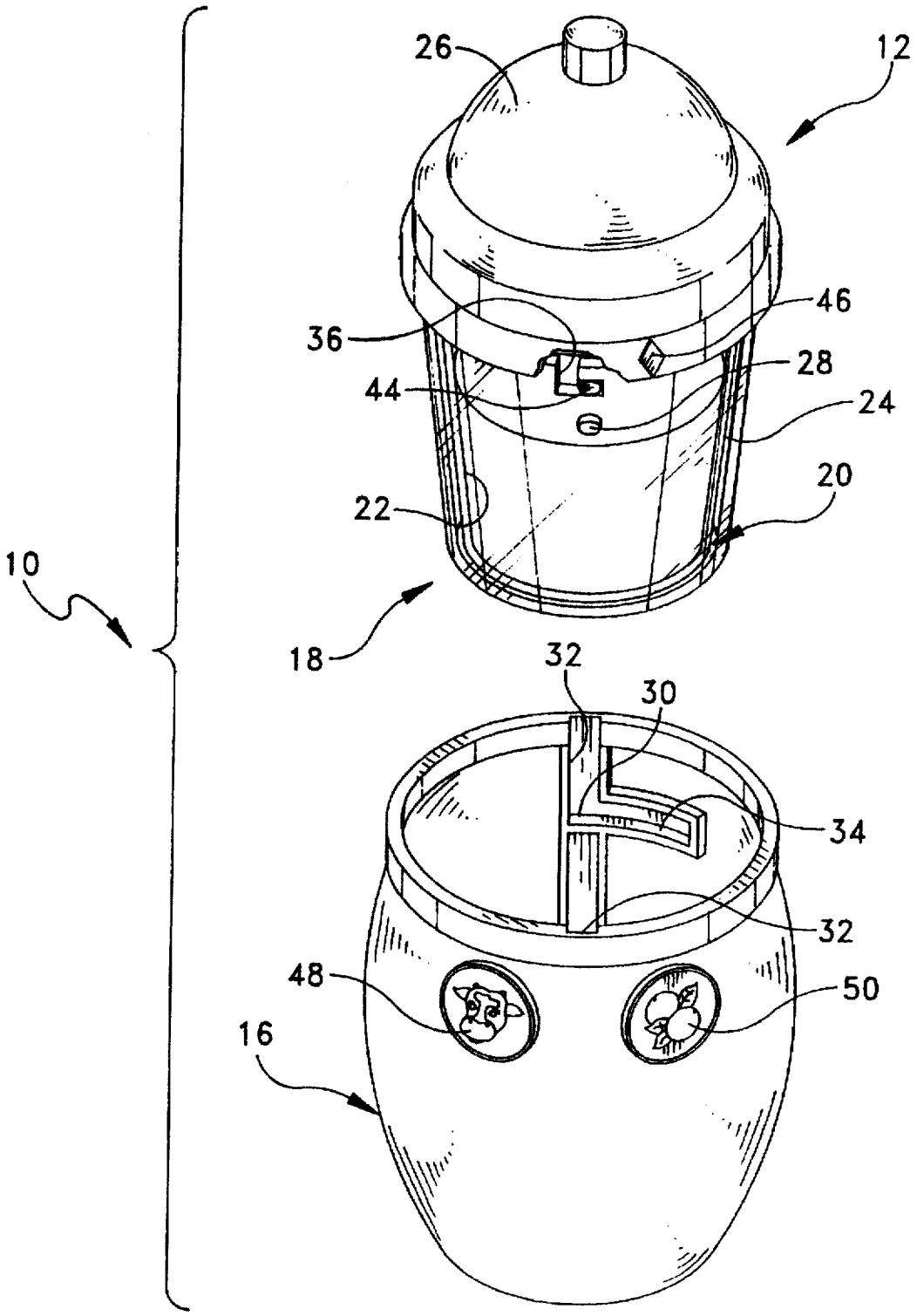
FIG. 6 is an assembly view showing removal of the interlocked bottle and sleeve from the warmer cup.

Still referring to FIG. 2, and in addition, FIG. 6, the sleeve 18 further comprises a pair of oppositely positioned L-shaped notched slots 36 formed therein, each slot having a vertical portion 38 and a horizontal portion 40. As shown, these slots 36 are formed along the upper edge 42 of the sleeve 18 (see FIG. 2) directly above the posts 28. The outer Bottle section 24 of the bottle portion 20 further includes a pair of oppositely positioned, outwardly projecting posts 44 formed thereon which correspond with the slots 36 of the sleeve 18. Much in the same manner as the sleeve 18 is received within the warmer housing 16, the bottle portion 20 is received within the sleeve. As shown, the bottle portion 20 is received concentrically within the sleeve 18 and the posts 44 of the bottle portion are slidably received within the vertical portions 38 of the slots 36 of the sleeve. Upon being completely received within the sleeve 18, the bottle portion 20 can then be rotated so that the posts 44 travel within the horizontal portions 40 of the slots 36 of the sleeve for locking the bottle portion within the sleeve. In the illustrated embodiment, this arrangement is achieved by rotating the bottle portion 20 in a counterclockwise direction with respect to the sleeve 18.

In this regard, the warmer housing 16, the sleeve 18 and the bottle 12 are adapted so that when an indicator marking (or arrow) 46 on the cap portion 26 of the bottle 12 is rotatably aligned with a milk icon ("first icon") 48 on the warmer housing 16, the sleeve 18 is retained in the warmer housing. Accordingly, when the bottle 12 is removed from the warmer assembly 14, the bottle appears to be filled with milk. The warmer housing 16, sleeve 18 and bottle 12 are further adapted so that when the indicator marking 46 is rotatably aligned with a juice icon ("second icon") 50 on the warmer housing 16, the sleeve 18 is retained on the bottle 12. Accordingly, when the bottle 12 is removed, the bottle appears to be filled with juice.

More specifically, when arranged in the manner illustrated in FIG. 1, in which the indicator 46 is aligned with the first icon 48, the posts 28 of the sleeve 18 are received within the horizontal portions 34 of the slots 30 of the warmer housing 16 for maintaining an axial interlock between the sleeve and the warmer housing. The bottle portion 20, in this position, is completely disposed within the sleeve 18; however, the posts 44 of the bottle portion 20 are aligned with the vertical portions 38 of the slots 36 of the sleeve 18 so that upon applying an axial force on the bottle 12 away from the warmer assembly 14, the bottle is removed from the warmer assembly. In this position, as mentioned above, the sleeve 18 remains within the warmer housing 16 and the liquid contained within the bottle portion 20 retains its milky color.

Upon rotating the indicator 46 so that it is aligned with the second icon 50, the posts 28 of the sleeve 18 are rotated so that they are aligned with the vertical portions 32 of the slots 30 of the warmer housing 16 for enabling the removal of the sleeve 18 from the warmer housing 16. In addition, the posts 44 of the bottle portion 20 are then rotated so that they are received within the horizontal portions 40 of the slots 36 of the sleeve 18 so that axial movement between the bottle and the sleeve is prohibited. The bottle portion 20 and sleeve 18 are interlocked in this position. However, since the posts 28 of the sleeve 18 are aligned with the vertical portions 32 of the slots 30 of the warmer housing 16, axial movement between the sleeve and the warmer housing is permitted.

Upon applying an axial force on the cap portion 26 of the bottle 12 away from the warmer housing 16, the bottle 12 and sleeve 18 are removed from the warmer housing. In this position, as mentioned above, the sleeve 18 remains with the bottle and the liquid contained within the bottle portion 20 resembles juice.

It can therefore be seen that the instant invention provides a unique and novel toy feeding bottle assembly 10 which can alternately appear to be filled with milk or juice. The removable sleeve 18 simply and effectively provides the ability to change the color of the liquid in the bottle 12 thereby simulating that the type of liquid in the bottle has been changed. The unique arrangement of the sleeve 18 and warmer housing 16 provides the ability to mount the sleeve onto the bottle 12 without the outside appearance of any pieces or parts being assembled. Furthermore, the arrangement of the rotating engagement posts and slots effectively provides the user with a simple and effective method for selecting whether the sleeve 18 will be retained within the warmer housing 16 or on the bottle 12. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

We claim:

1. A toy feeding bottle assembly comprising:

a bottle including a transparent bottle portion having a liquid received therein, a cap portion received on the bottle portion and a post extending outwardly from an outer surface of the bottle portion; and a transparent sleeve which is selectively receivable on an outer surface of said bottle portion, said sleeve being colored so as to impart a different color to the liquid when the sleeve is received on the bottle, said sleeve having a slot formed therein which is adapted and positioned for receiving said post therein, said post being slidably and rotatably engaged with said slot.

2. A toy feeding bottle assembly comprising:

a bottle including transparent bottle portion and a liquid received therein and further including a cap portion received on the bottle portion; and a warmer assembly including an outer cup-shaped warmer housing and an inner transparent sleeve which are received in interfitting concentric relation, said bottle being selectively receivable within said warmer assembly in interfitting concentric relation, said bottle, said warmer housing and said sleeve being adapted so that said sleeve is selectively retained either inside said warmer housing or on an outer surface of said bottle portion of said bottle when said bottle is removed from said warmer assembly, said sleeve being colored so as to impart a different color to the liquid when the sleeve is retained on the bottle.

3. The toy feeding bottle assembly of claim 2 further comprising means for selectively interlocking said sleeve with said bottle portion, and means for selectively interlocking said warmer housing with said sleeve.

4. The toy feeding bottle assembly of claim 3 wherein said means for selectively interlocking said sleeve and said bottle portion comprises interengaging formations respectively formed on said bottle portion and said sleeve, and further wherein said means for selectively interlocking said warmer housing and said sleeve comprises interengaging formations formed on said warmer housing and said sleeve.

5. The toy feeding bottle assembly of claim 4 wherein said means for selectively interlocking said sleeve and said bottle comprises a post extending outwardly from an outer surface of said bottle portion of said bottle, and a corresponding notched slot formed in said sleeve, said post being slidably and rotatably engaged with said slot, and further wherein said means for selectively interlocking said warmer housing and said sleeve comprises a post extending outwardly from an outer surface of said sleeve and a corresponding notched slot formed in an inner surface of said warmer housing, said post on said sleeve being slidably and rotatably engaged with said slot in said warmer housing.

6. A toy bottle assembly comprising:

a bottle including a transparent bottle portion, a liquid received therein, a cap portion received on the bottle portion and an indicator marking on said cap portion;

a warmer assembly including a cup-shaped warmer housing having first and second circumferentially spaced icons on an outer surface thereof, and a transparent inner sleeve which are received in interfitting concentric relation, said bottle being selectively receivable within said warmer assembly in interfitting concentric relation, said bottle being rotatable within said warmer assembly between a first position wherein said indicator marking is rotatably aligned with said first icon and a second position wherein said indicator marking is rotatable aligned with said second icon;

means for releasably retaining the sleeve within the warmer housing as the bottle is removed from the warmer assembly when the bottle is rotated to the first position; and means for releasably retaining the sleeve on the bottle as the bottle is removed from the warmer assembly when the bottle is in the second position, said outer sleeve being colored so as to impart a different color to the liquid when the sleeve is retained on the bottle.

7. The toy bottle assembly of claim 6 wherein said means for releasably retaining the sleeve within the warmer housing comprises a post extending outwardly from an outer surface of said sleeve and a corresponding notched slot formed in an inner surface of said warmer housing, said post on said sleeve being slidably and rotatably engaged with said slot in said warmer housing, and further wherein said means for releasably retaining the sleeve on the bottle comprises a post extending outwardly from an outer surface of said outer bottle section, and a corresponding notched slot formed in said outer sleeve, said post of said bottle being slidably and rotatably engaged with said slot in said sleeve.

8. The toy bottle assembly of claim 7 wherein one of said slot in said warmer housing and said slot in said sleeve extends circumferentially in a clockwise direction, while the other extends circumferentially in a counterclockwise direction.

* * * * *